US009289639B1

(12) United States Patent
Colby

(10) Patent No.: US 9,289,639 B1
(45) **Date of Patent: *Mar. 22, 2016**

(54) RESISTANCE TRAINING APPARATUS

(71) Applicant: COREPUMP, LLC, Scottsdale, AZ (US)

(72) Inventor: Samuel D. Colby, Scottsdale, AZ (US)

(73) Assignee: COREPUMP, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,021

(22) Filed: Aug. 30, 2015

Related U.S. Application Data

(63) Continuation of application No. 13/905,670, filed on May 30, 2013, now Pat. No. 9,119,986.

(60) Provisional application No. 61/689,093, filed on May 30, 2012.

(51) Int. Cl.

| | |
|---|---|
| ***A63B 21/008*** | (2006.01) |
| ***A63B 21/05*** | (2006.01) |
| ***A63B 21/00*** | (2006.01) |
| ***A63B 23/12*** | (2006.01) |

(52) U.S. Cl.
CPC ..... *A63B 21/0087* (2013.01); *A63B 21/1469* (2013.01); *A63B 23/12* (2013.01)

(58) Field of Classification Search
CPC ..... A63B 21/105; A63B 21/008; A63B 21/0087; A63B 21/1469; A63B 21/1488; A63B 21/00069; A63B 21/0083; A63B 21/4047; A63B 22/0005; A63B 22/0015; A63B 22/0017; A63B 22/0046; A63B 23/1281; A63B 23/03575; A63B 23/0355; A63B 23/03525; A63B 23/0211; A63B 23/085; A63B 23/0233; A63B 25/08; A63B 2208/0204; A63B 2208/0214; A63B 2208/0238; A63B 2023/0411; A63B 2071/027; A63B 2244/08
USPC ..... 482/77, 91, 111–113, 128, 130, 138, 482/148, 908; 92/58.1; 74/551.3, 551.4
See application file for complete search history.

(56) References Cited

U.S. PATENT DOCUMENTS

| | | | | | |
|---|---|---|---|---|---|
| 2,223,309 | A * | 11/1940 | Swanson | A63B 21/00072 | 482/123 |
| 2,557,139 | A * | 6/1951 | Peters | F04B 33/00 | 16/438 |
| 2,677,975 | A * | 5/1954 | Russell | F04B 33/005 | 74/547 |
| 2,921,791 | A * | 1/1960 | Berne | A63B 21/015 | 248/188.1 |
| 3,713,653 | A * | 1/1973 | Romans | A63B 22/18 | 432/146 |

(Continued)

*Primary Examiner* — Oren Ginsberg
*Assistant Examiner* — Joshua Lee
(74) *Attorney, Agent, or Firm* — Michael W. Goltry; Robert A. Parsons; Parsons & Goltry

(57) ABSTRACT

A resistance training apparatus includes a resistance member, and a handle assembly arranged to reciprocate between proximal and distal positions against the resistance of the resistance member. The handle assembly includes a yoke. The yoke includes a first arm and an opposed second arm. The first arm has a first inner end and an opposed first outer end, and the second arm has a second inner end an opposed second outer end. A first handle is carried by the first end of the first arm, a second handle is carried by the second end of the second arm, and a third handle is connected between the first and second arms. The third handle extends between the first and second arms and is located between, on the one hand, the first and second handles and, on the other hand, the first and second inner ends of the first and second arms.

14 Claims, 12 Drawing Sheets

(56) References Cited

U.S. PATENT DOCUMENTS 3,863,521 A * 2/1975 Gatsos et al. ..... B62K 21/16 280/278
4,023,436 A * 5/1977 Dodge ..... B62K 21/16 74/551.3
D263,485 S * 3/1982 Rudell ..... D21/413
4,351,527 A * 9/1982 Crisp, Jr. ..... A63B 21/00043 482/121
4,390,178 A * 6/1983 Rudell ..... A63B 25/08 482/77
4,517,966 A * 5/1985 von Othegraven ... A61H 1/0218 482/122
4,720,100 A * 1/1988 Du Buy ..... A63B 23/12 482/112
4,828,251 A * 5/1989 Schreiber ..... A63B 26/003 482/77
5,037,088 A * 8/1991 Bernstein ..... A63B 21/0004 482/112
5,071,119 A * 12/1991 Johnson ..... A63B 21/0087 482/112
5,139,255 A * 8/1992 Sollami ..... A63B 22/0056 482/58
5,154,685 A * 10/1992 Chen ..... A63B 21/00043 482/121
5,487,709 A * 1/1996 Froelich, Sr. ..... A63B 21/015 482/119
5,695,436 A * 12/1997 Huang ..... A63B 21/0004 482/121
5,755,646 A * 5/1998 Chu ..... A63B 21/1403 482/115
6,290,630 B1 * 9/2001 Boland ..... A63B 21/0083 482/112
6,592,498 B1 * 7/2003 Trainor ..... A63B 21/062 482/46
6,712,742 B2 * 3/2004 Suiter ..... A63B 21/0004 482/140
6,726,603 B1 * 4/2004 Beaute ..... A63B 25/08 482/77
6,827,673 B2 * 12/2004 Chen ..... A63B 25/08 482/112
7,115,079 B2 * 10/2006 Yu ..... A63B 23/0211 482/121
7,569,003 B1 * 8/2009 Huffman ..... A63B 21/00043 482/111
7,678,032 B2 * 3/2010 Footnick ..... A63B 21/0083 482/111
7,837,598 B1 * 11/2010 Boozel, Jr. ..... A63B 21/1434 482/38
7,867,152 B1 * 1/2011 Harris, Jr. ..... A63B 21/0083 482/112
7,896,785 B1 * 3/2011 Marcus ..... A63B 21/0087 482/111
8,029,011 B2 * 10/2011 King ..... B62K 11/14 280/279
2001/0031687 A1 * 10/2001 McAlonan ..... A63B 21/0004 482/77
2002/0188236 A1 * 12/2002 Lin ..... A61H 9/0078 601/107
2003/0162638 A1 * 8/2003 Verheem ..... A63B 21/05 482/123
2012/0193160 A1 * 8/2012 Wu ..... B62K 5/007 180/208
2013/0005542 A1 * 1/2013 Wu ..... A63B 21/05 482/128
2013/0210587 A1 * 8/2013 Shank ..... A63B 25/08 482/77

* cited by examiner

FIG. 18
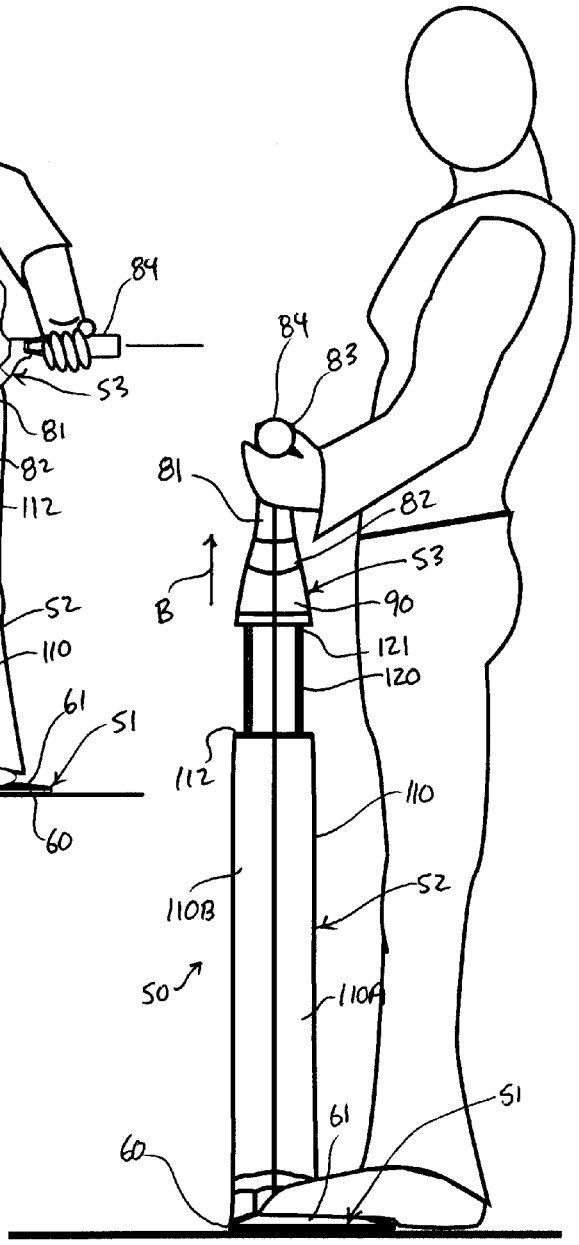
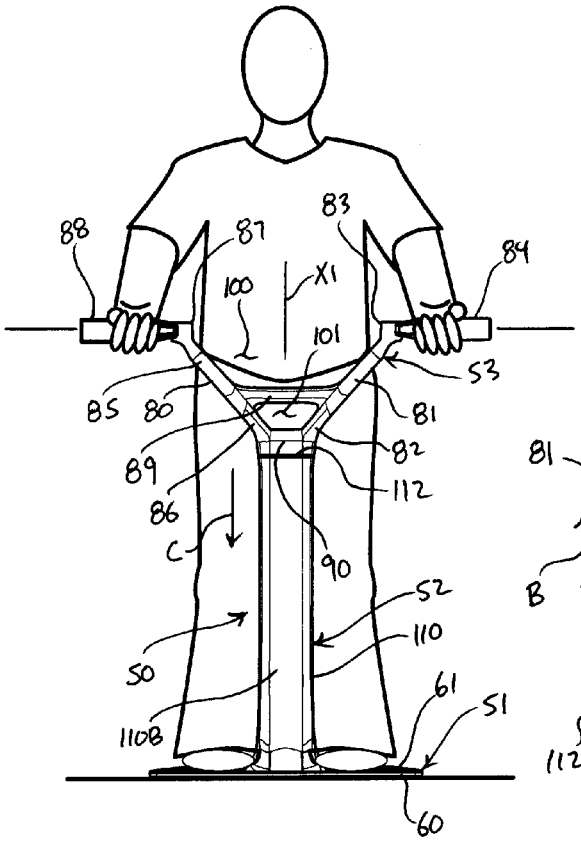
FIG. 19

RESISTANCE TRAINING APPARATUS

FIELD OF THE INVENTION

The present invention relates resistance training equipment.

BACKGROUND OF THE INVENTION

Strength training involving resistance exercise is useful for building strength, anaerobic endurance, and size of skeletal muscles. When properly performed, strength training can produce significant health benefits, including increased bone, muscle, tendon and ligament strength and toughness, improved joint function, reduced potential for injury, increased bone density, increased metabolism, and improved cardiac function and mobility.

There are many types of resistance training equipment, and each has advantages and disadvantages. Some are more appropriate for home gyms, and others are better suited for public gyms. The biggest difference between the many types of resistance training equipment is the means by which they provide the resistance that is crucial to effective resistance training. The different types of resistance training equipment include free weights, weight machines, and resistance bands or tubes.

The most common form of resistance training equipment is free weights. This form of weight training equipment consists of some combination of dumbbells, barbells and weight benches and racks. Although the weights of some dumbbells are adjustable, fixed weight dumbbells are more common, requiring a large collection of them to facilitate a wide array of exercises.

Free weights have several distinct advantages and disadvantages. Free weights are effective for resistance training because they are inherently unstable, requiring the athlete to balance the weight during lifting thereby engaging the body's stabilizer muscles. As a result, free weights can provide for advanced, high-intensity strength training and can improve mobility. However, it can often be difficult to maneuver free weights into the proper position for lifting. As a result, free weights require additional equipment for proper and safe use, including racks and benches.

Unlike free weights, resistance bands and resistance tubes require far less equipment and can be much easier to use. Rather than requiring an extensive amount of equipment, resistance bands and tubes provide athletes with a variety of different levels of resistance simply by shortening or lengthening the band or adjusting the tube. Also, an athlete can reposition a single band or tube in a variety of ways in order to perform different lifts. However, resistance bands and tubes cannot provide high levels of resistance that free weights can provide. Resistance bands must stretch in order to provide the desired resistance and there are some angles of resistance that bands cannot provide, which limits their use.

Another form of resistance training equipment is weight machines. This form of weight training equipment can provide the same high levels of weight that free weights provide, all while tending to maintain proper lifting form. The drawback to weight machines is that each machine usually can allow an athlete to perform only one or two exercises. To get a complete workout, an athlete would need access to a large number of machines, which makes them ill-suited for most home gyms.

SUMMARY OF THE INVENTION

According to the principle of the invention, a resistance training apparatus includes a resistance member that provides resistance to movement, and a handle assembly arranged to reciprocate between proximal and distal positions against the resistance of the resistance member. The handle assembly includes a yoke. The yoke includes a first arm and an opposed second arm. The first arm has a first inner end and an opposed first outer end. The second arm has a second inner end an opposed second outer end. A first handle is carried by the first end of the first arm. A second handle is carried by the second end of the second arm. A third handle is connected between the first and second arms. The third handle extends between the first and second arms and is located between, on the one hand, the first and second handles and, on the other hand, the first and second inner ends of the first and second arms. The resistance member is pneumatic piston-cylinder assembly for providing resistance to movement of the handle assembly in a first direction from the proximal position of the handle assembly to the distal position of the handle assembly, and in a second direction from the distal position of the handle assembly to the proximal position of the handle assembly. The resistance training apparatus further includes a housing assembly for the resistance member. The housing assembly includes mutually reciprocal proximal and distal housing parts. The distal housing part is an extension of the handle assembly. The proximal and distal housing parts enclose the resistance member in the proximal and distal positions of the handle assembly, and at every position of the handle assembly between the proximal and distal positions. The first and second handles are mounted to the first and second outer ends of the first and second arms between inner positions, outer positions, and intermediate positions between the inner and outer positions. A first lock assembly is coupled between the first handle and the first outer end of the first arm for selectively releasably securing the first handle in the inner position, the outer position, and the intermediate position, and a second lock assembly is coupled between the second handle and the second outer end of the second arm for selectively releasably securing the second handle in the inner position, the outer position, and the intermediate position. The first and second handles are parallel relative to each other in the intermediate positions, share a common axis in inner positions and the outer positions, and are parallel relative to the third handle in the inner positions and in the outer positions.

According to the principle of the invention, a resistance training apparatus includes a base, a resistance member, and a handle assembly. The resistance member provides resistance to movement, and the resistance member extends upright from the base. The handle assembly is arranged to reciprocate between lowered and raised positions against the resistance of the resistance member. The handle assembly includes a yoke. The yoke includes a first arm having a first outer end and an opposed second arm having a second outer end. A first handle is carried by the first end of the first arm. A second handle is carried by the second end of the second arm. The first and second handles are mounted for pivotal movement to the first and second outer ends of the first and second arms between inner positions, outer positions, and intermediate positions between the inner and outer positions. The base adapted to support a user in a standing position from which position said user can perform exercise against the resistance of the resistance member by manually applying pushing and pulling forces to the handle assembly at the first and second handles. The handle assembly reciprocates along a central axis, the first and second handles pivot about first and second axes, respectively, on either side of the central axis, and the central, first, and second axes are parallel relative to each other. A first lock assembly is coupled between the first handle and the first outer end of the first arm for selectively releasably securing the first handle in the inner position, the outer position, and the intermediate position. A second lock assembly is coupled between the second handle and the second outer end of the second arm for selectively releasably securing the second handle in the inner position, the outer position, and the intermediate position. The first and second handles are parallel relative to each other in the intermediate positions, and share a common axis in the inner and outer positions. The resistance member is pneumatic piston-cylinder assembly for providing resistance to movement of the handle assembly in a first direction from the proximal position of the handle assembly to the distal position of the handle assembly, and in a second direction from the distal position of the handle assembly to the proximal position of the handle assembly. The resistance training apparatus further includes a housing assembly for the resistance member. The housing assembly includes mutually reciprocal proximal and distal housing parts. The distal housing part is an extension of the handle assembly, and the proximal and distal housing parts enclose the resistance member in the proximal and distal positions of the handle assembly and at every position of the handle assembly between its proximal and distal positions. A third handle is connected between the first and second arms. The third handle positioned between, on the one hand, the first and second handles and, on the other hand, the resistance member.

According to the principle of the invention, a resistance training apparatus includes a base, a resistance member, and a handle assembly. The resistance member provides resistance to movement, and extends upright from the base. The handle assembly is arranged to reciprocate between proximal and distal positions against the resistance of the resistance member. The handle assembly includes a yoke. The yoke includes a first arm and an opposed second arm. The first arm has a first inner end and an opposed first outer end. The second arm has a second inner end an opposed second outer end. A first handle is carried by the first end of the first arm. A second handle is carried by the second end of the second arm, and a third handle is connected between the first and second arms. The third handle extends between the first and second arms and is located between, on the one hand, the first and second handles and, on the other hand, the first and second inner ends of the first and second arms. The base is adapted to support a user in a standing position from which position said user can perform exercise against the resistance of the resistance member by manually applying pushing and pulling forces to the handle assembly at, one the one hand, the first and second handles, and, on the other hand, the third handle. The resistance member is pneumatic piston-cylinder assembly for providing resistance to movement of the handle assembly in a first direction from the proximal position of the handle assembly to the distal position of the handle assembly, and in a second direction from the distal position of the handle assembly to the proximal position of the handle assembly. The resistance training apparatus further includes a housing assembly for the resistance member. The housing assembly includes mutually reciprocal proximal and distal housing parts. The distal housing part is an extension of the handle assembly, and the proximal and distal housing parts enclose the resistance member in the proximal and distal positions of the handle assembly, and at every position of the handle assembly between the proximal and distal positions. The first and second handles are mounted to the first and second outer ends of the first and second arms for pivotal movement between inner positions, outer positions, and intermediate positions between the inner and outer positions. The handle assembly reciprocates along a central axis, the first and second handles pivot about first and second axes, respectively, on either side of the central axis, and the central, first, and second axes are parallel relative to each other. A first lock assembly is coupled between the first handle and the first outer end of the first arm for selectively releasably securing the first handle in the inner position, the outer position, and the intermediate position. A second lock assembly is coupled between the second handle and the second outer end of the second arm for selectively releasably securing the second handle in the inner position, the outer position, and the intermediate position. The first and second handles are parallel relative to each other in the intermediate positions, share a common axis in inner positions and the outer positions, and are parallel relative to the third handle in the inner positions and in the outer positions.

BRIEF DESCRIPTION OF THE DRAWINGS

Referring to the drawings:

FIGS. 18 and 19 are left side elevation and rear elevation views, respectively, of the embodiment of FIG. 1 shown as it would appear in use with the handles in the outer positions as in FIG. 9.

DETAILED DESCRIPTION

Figure 2:
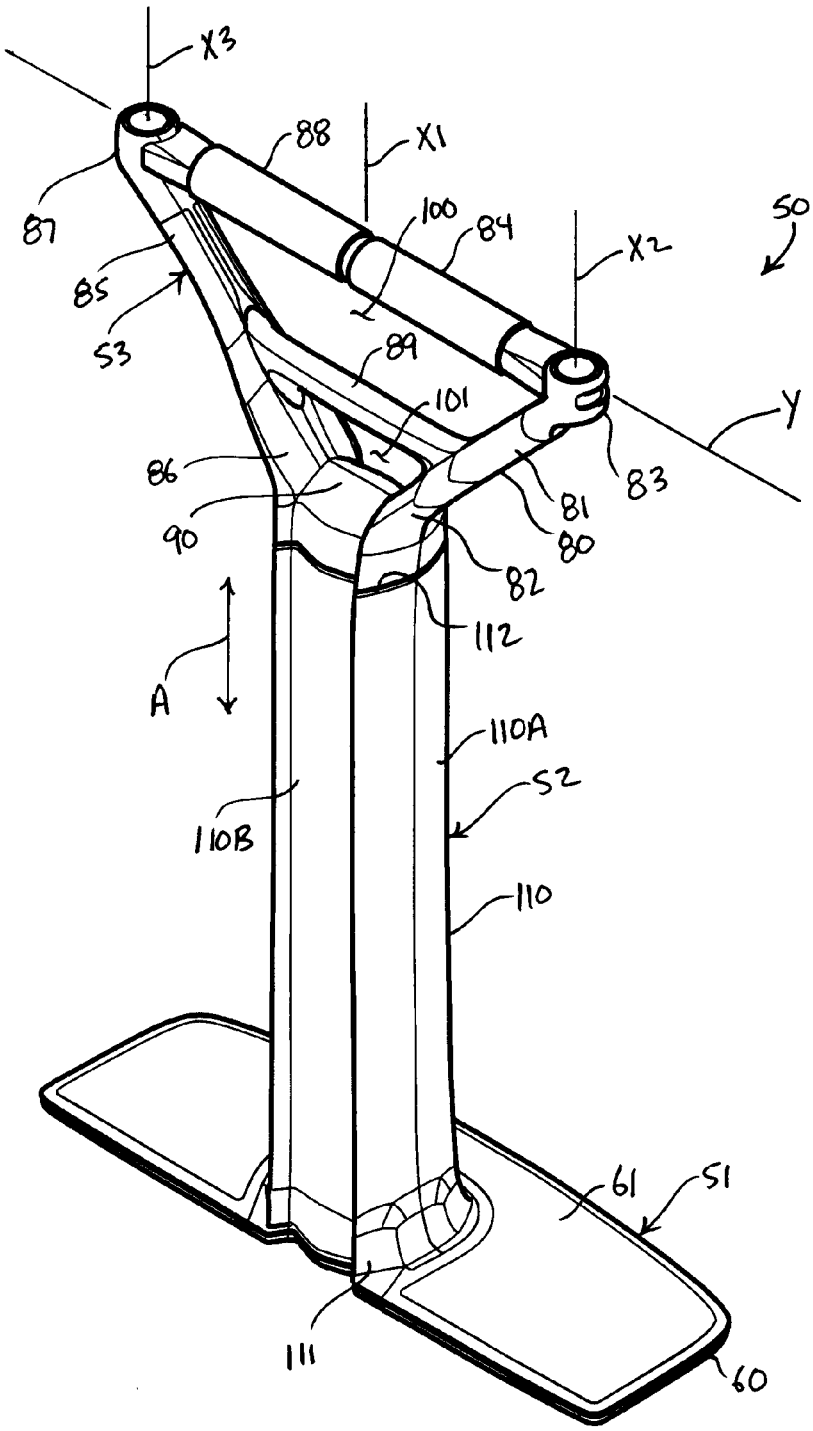
FIG. 2 is a front perspective view of the embodiment of FIG. 1.
Figure 3:
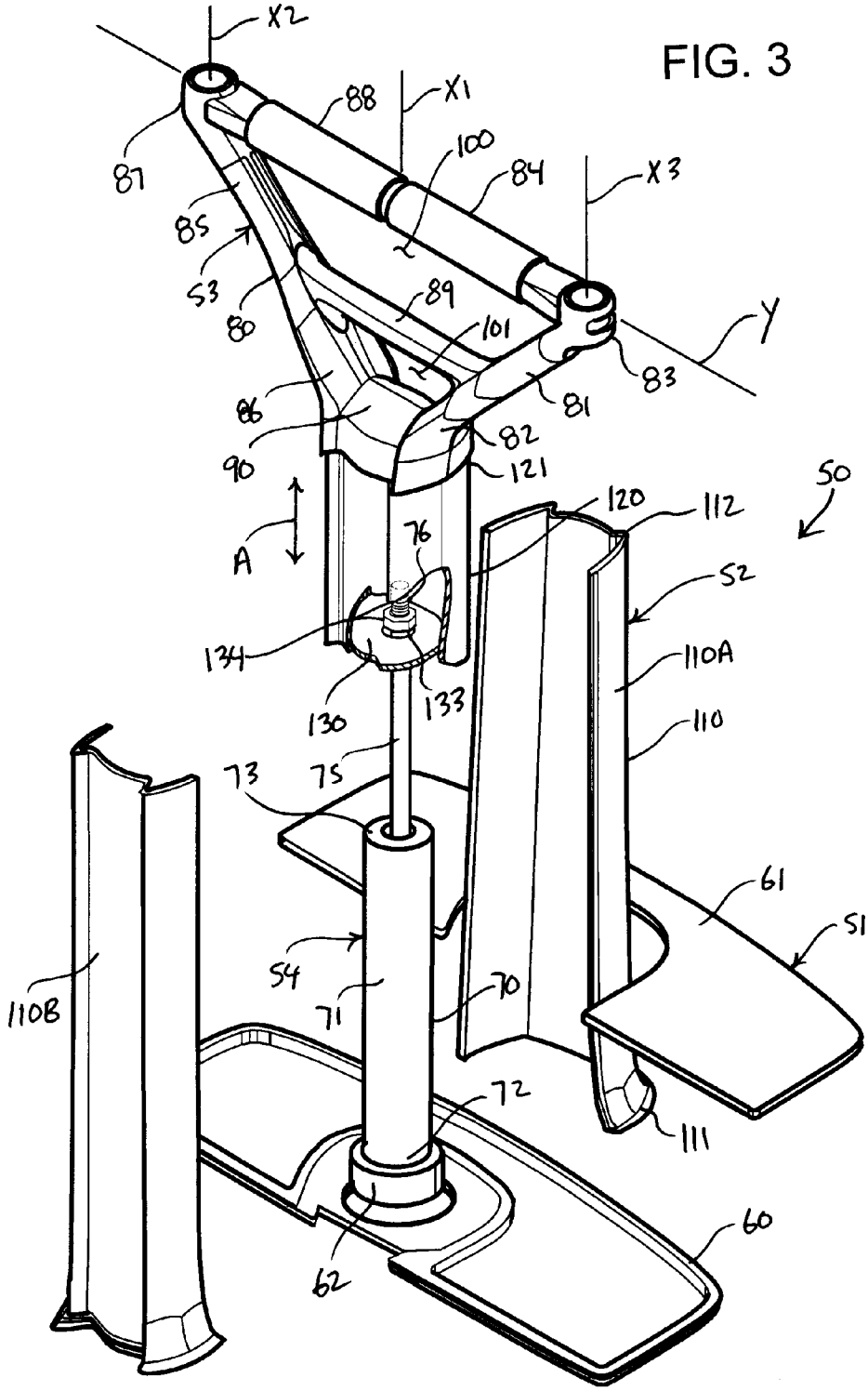
FIG. 3 is a partially exploded front perspective view of the embodiment of FIG. 1 illustrating the handle assembly, the base, a resistance member coupled between the base and the handle assembly, and the housing assembly, including portions of the housing assembly incorporated with the handle assembly shown broken away for illustrative purposes.
Figure 4A:
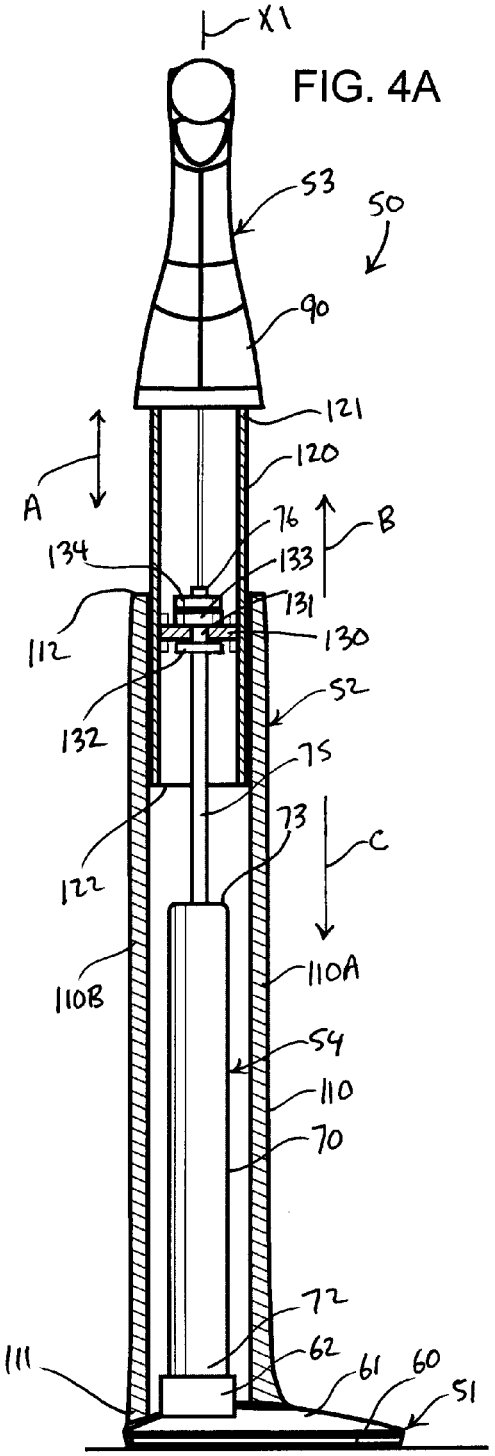
FIG. 4A is a partial vertical section view of the embodiment of FIG. 1 illustrating the resistance member of FIG. 3 coupled between the base and the handle assembly, and further illustrating the cylinder assembly extended in a raised position of the handle assembly.
Figure 4B:
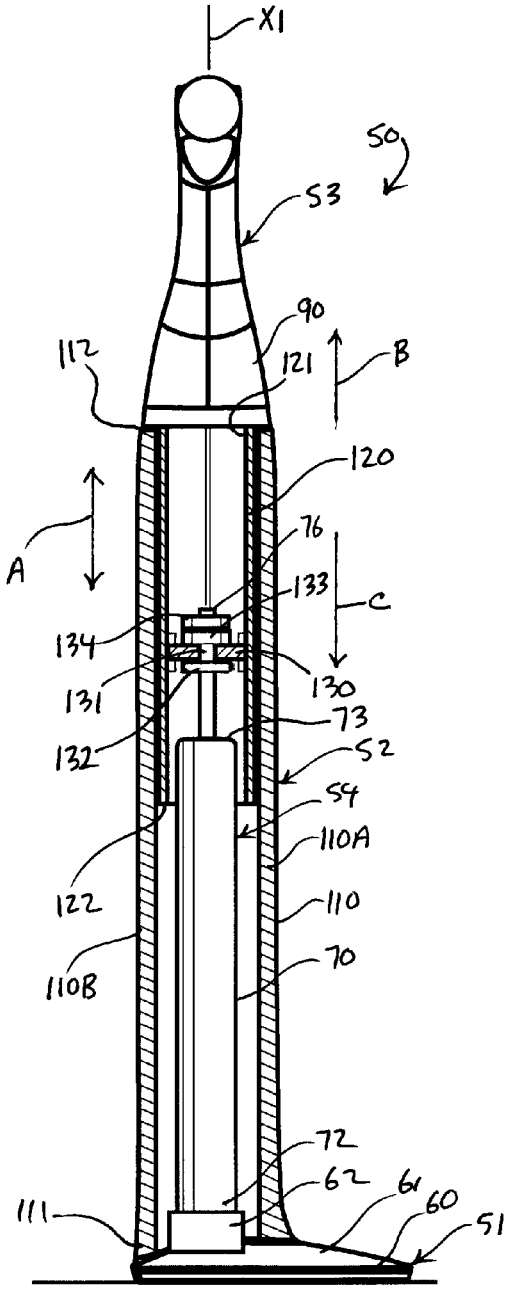
FIG. 4B is a view similar to that of FIG. 4A illustrating the cylinder extended retracted in the lowered position of the handle assembly.
Figure 5:
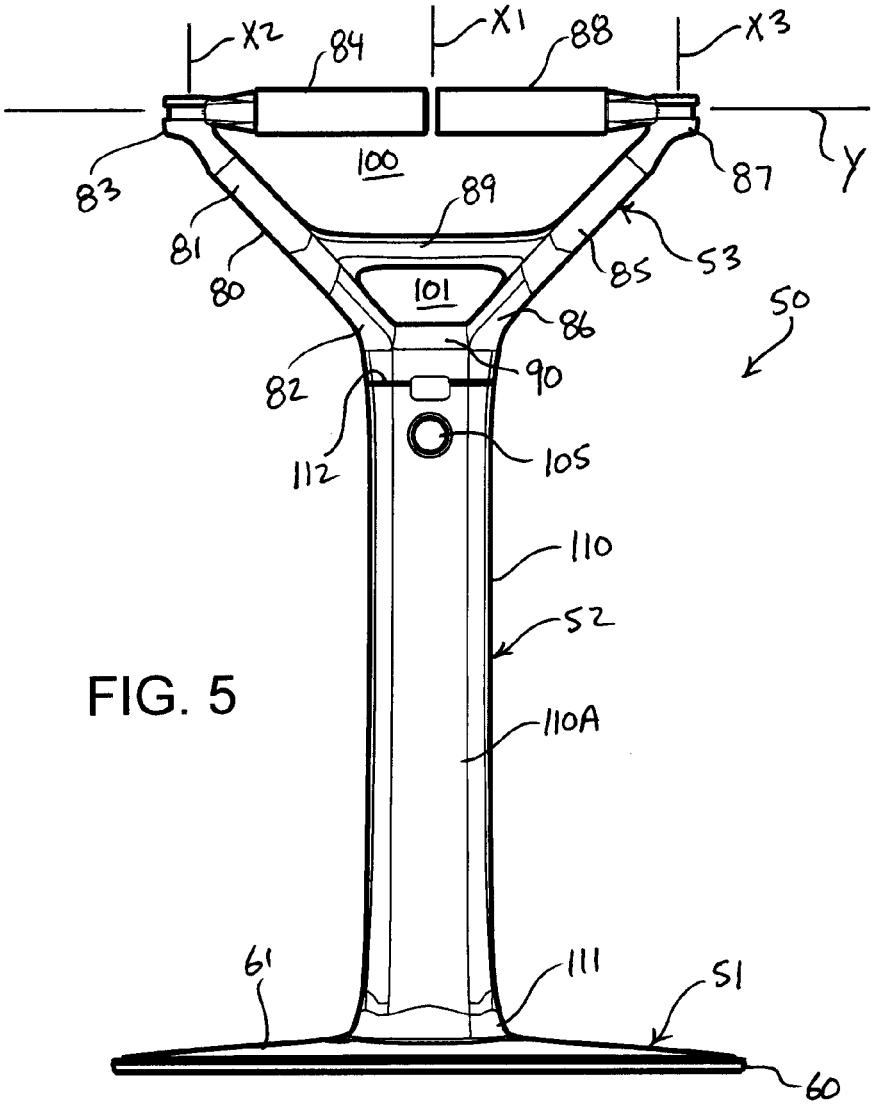
FIG. 5 is a rear elevation view of the embodiment of FIG. 1.
Figure 6:
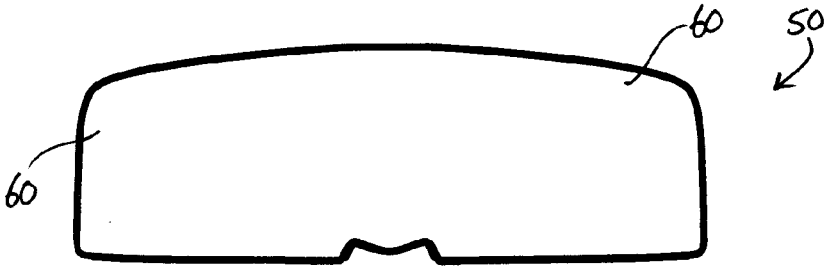
FIG. 6 is a bottom plan view of the embodiment of FIG. 1.
Figure 7:
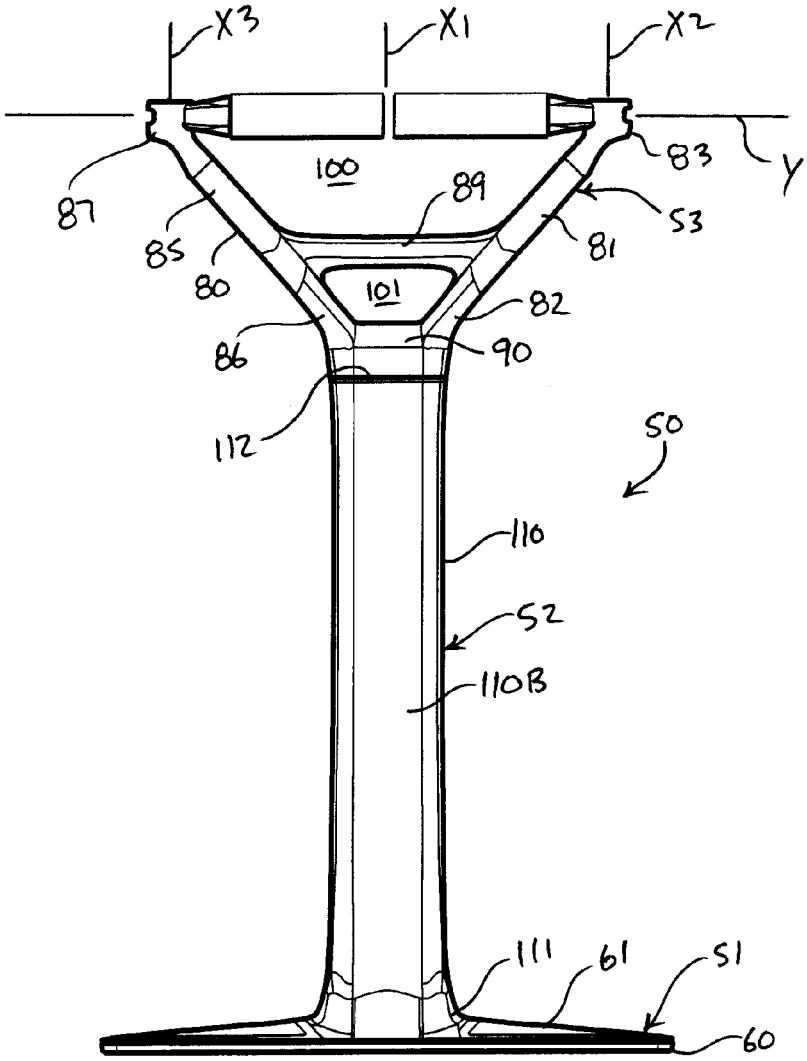
FIG. 7 is a front elevation view of the embodiment of FIG. 1.
Figure 8:
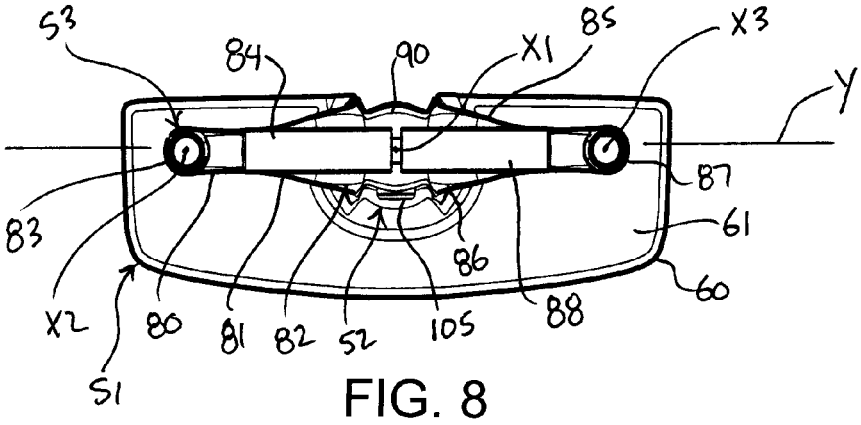
FIG. 8 is a top plan view of the embodiment of FIG. 1 illustrating handles of the handle assembly of the resistance training apparatus positioned in inner positions.

Turning now to the drawings, in which like reference characters indicate corresponding elements throughout the several views, attention is directed to FIGS. 1-13, 18, and 19, in which there is seen a resistance training apparatus 50 including base 51, upstanding housing assembly 52, handle assembly 53, and, in reference to FIGS. 3, 4A, and 4B, resistance member 54. Base, upstanding housing assembly 52, and handle assembly are fashioned of aluminum, steel, plastic, carbon fiber, or other material or combination of materials having the material properties or characteristics of strength, sufficient rigidity to facilitate normal use as described herein, and impact resistance. Base 51 is an assembly consisting of a fixed lower section 60 and an upper footplate 61 mounted on lower section 60, such as by welding, adhesive, snap-fit joinery, or the like. A central extension of lower section 60 illustrated in FIGS. 3, 4A, and 4B forms a coupling or receiver 62 for resistance member 54, and resistance member 54 extends vertically upright from lower section 60 of base 51 between base 51 and handle assembly 53. Resistance member 54 provides resistance to movement, and is a conventional, well known, and readily available pneumatic piston-cylinder assembly 70 including cylinder 71 and operating rod 75. Cylinder 71 has opposed inner and outer ends 72 and 73. Inner end 72 of cylinder 71 is rigidly connected to receiver 62, which, in turn, rigidly connects inner end 72 of cylinder 71 of assembly 70 to lower section 60 of base 51. In this example receiver 62 is a socket into which inner end 72 of cylinder 71 is fitted and rigidly connected. In this embodiment, a press fit between inner end 72 of cylinder 71 and receiver 62 rigidly connects inner end 72 of cylinder 71 to lower section 60 of base 51. In other examples, inner end 72 of cylinder 71 may be rigidly connected to receiver 62 with one or more set screws, adhesive, threaded joinery, or the like. Cylinder 71 extends vertically upright from inner end 72 at base 51 to outer end 73 and to operating rod 75. Operating rod 75 is mounted partially within cylinder 71 through outer end 73 for reciprocal movement therein, and terminates with outer end 76. Operating rod 75 extends vertically upright from outer end 73 of cylinder 71. Assembly 70 provides bidirectional resistance to reciprocal movement of operating rod 75 relative to cylinder 71. The resistance to movement offered by assembly 70 can be a fixed or constant resistance, variable resistance, or an adjustable resistance.

Figure 1:
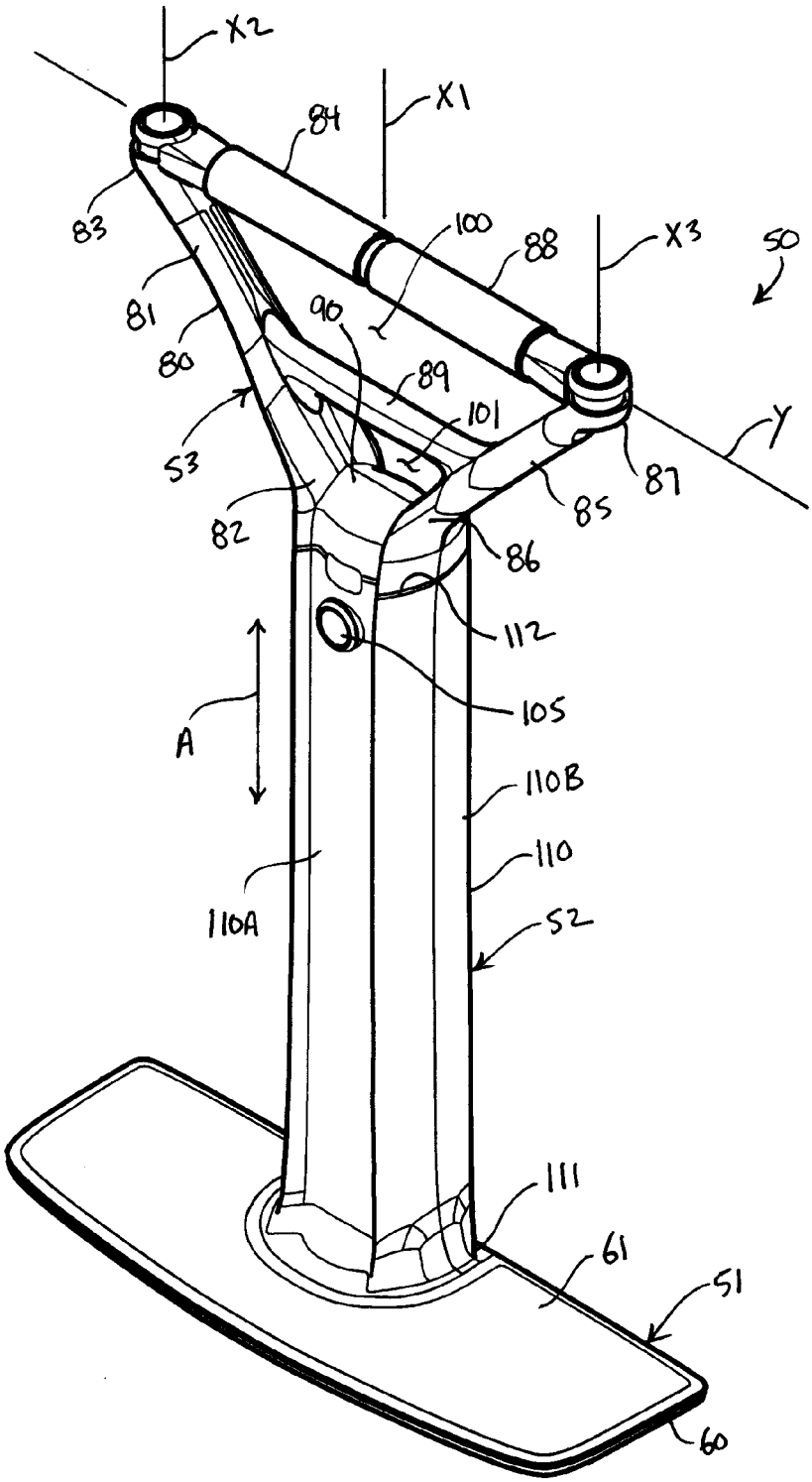
FIG. 1 is rear perspective view of a resistance training apparatus constructed and arranged in accordance with the principle of the invention, the resistance training apparatus including an upright housing assembly extending between a base and a handle assembly having opposed handles.

Handle assembly 53 is operatively coupled to operating rod 75 of assembly 70 and is arranged to reciprocate in the directions of double arrowed line A along a central axis X1 in FIGS. 1-4B between a proximal, lowered, or retracted position toward base 51, as shown in FIGS. 1, 2, and 4B, and a distal, raised, or extended position away from base 51, as shown in FIG. 4A, against the resistance of resistance member 54. Assembly 70 is arranged about axis X1, as is housing assembly 52. Operating rod 75 reciprocates relative to cylinder 71 along axis X1 between a retracted position as in FIG. 4B, and an extended position as in FIG. 4A. In the retracted position of operating rod 75 as in FIG. 4B, assembly 70 is in a retracted or lowered position. In the extended position of operating rod 75 as in FIG. 4A, assembly 70 is in an extended or raised position. FIG. 4A illustrates assembly 70 as it would appear in its extended or raised position corresponding to the distal, extended, or raised position of handle assembly 53. FIG. 4B illustrates assembly 70 as it would appear in its retracted or lowered position corresponding to the proximal, retracted, or lowered position of handle assembly 53. Handle assembly 53 thus reciprocates against assembly 70 along axis X1 between its proximal, retracted, or lowered position, and its distal, extended, or raised position against operating rod 75, whereby operating rod 75, in turn, concurrently reciprocates along axis X1 between its retracted and extended positions in response to the reciprocal movement of handle assembly 53 between its proximal, retracted, or lowered position and its distal, extended, or raised position.

Referencing in relevant part FIGS. 1-3, 5, 7-14, and 17-19, handle assembly 53 includes yoke 80. Yoke 80 includes arms 81 and 85, which are coextensive and the mirror image of one another. Arm 81 has inner or proximal end 82 and opposed outer or distal end 83, and arm 85 has inner or proximal end 86 and opposed outer or distal end 87. Handle 84 is carried by outer end 83 of arm 81, and handle 88 is carried by outer end 87 of arm 85. Handles 84 and 88 are provided specifically to be grasped or held by hand and subjected to the manual application of forces by a user for bidirectional resistance training. Handles 84 and 88 extend outwardly from outer ends 83 and 87 of arms 81 and 85, respectively, so as to allow a user to grip handles 84 and 88 by hand by wrapping his/her hand and fingers completely around handles 84 and 88 without restriction to facilitate an aggressive and comfortable grip for lifting/pulling and lowering/pushing handle assembly 53 up and down between its proximal, lowered, or retracted position and its distal, raised, or extended position.

Inner ends 82 and 86 of arms 81 and 85, respectively, are rigidly connected to a hub 90 of yoke 80. Preferably, arms 81 and 85 are integrally formed with hub 90, such as by molding or machining. In an alternate embodiment, arms 81 and 85 may be welded to hub 90, connected to hub with mechanical fasteners, such as screws, rivets, or the like, or rigidly secured with suitable joinery. Arms 81 and 85 extend upright and diverge outward from inner ends 82 and 86 at hub 90 to outer ends 83 and 87 connected to handles 84 and 88, respectively. In other words, arms 81 and 85 diverge angularly upright from hub 90 to outer ends 83 and 87, respectively. Arms 81 and 85 diverge angularly outward from hub 90 in a V-shaped arrangement. Handle 89 is connected to arms 81 and 85 and is positioned between arms 81 and 85. Handle 89 extends between arms 81 and 85 and is located between, on the one hand, handles 84 and 88 connected to outer ends 83 and 87 of arms 81 and 85, and, on the other hand, inner ends 82 and 86 of arms 81 and 85 connected to hub 90. Handle 89 is an intermediate handle of apparatus 50, and is positioned between outer ends 83 and 87 of arms 81 and 85, and the middle of handle 89 is arranged about axis X1. In other words, axis X1 extends through the middle of handle 89. Open spaces 100 and 101 between arms 81 and 85 are defined on either side of handle 89. Space 100 is between handle 89 and outer ends 83 and 87 and handles 84 and 88, and space 101 is between handle 89 and hub 90 and inner ends 82 and 86 of arms 81 and 85. Handle 89, like handles 84 and 88, is provided specifically to be grasped or held by hand and subjected to the manual application of forces by a user for bidirectional resistance training. Handle 89 is located between spaces 100 and 101, wherein space 100 is vertically above handle 89 and space 101, space 101 is vertically below handle 89 and space 100, and space 101 is vertically above hub 90. Spaces 100 and 101 on either side of handle 89 allow a user to grip handle 89 by hand by wrapping his/her hand and fingers completely around handle 89 without restriction to facilitate an aggressive and comfortable grip for lifting/pulling and lowering/pushing handle assembly 53 up and down between its proximal, lowered, or retracted position and its distal, raised, or extended position. Handle 89 may be gripped by one hand for resistance training purposes, of by two hands for resistance training purposes. To facilitate gripping, the exterior surfaces of handles 84, 88, and 89 may be formed with gripping material, such as rubber or a high-friction surface application or jacket to enhance grip and reduce slippage.

Referencing FIGS. 1-4B in relevant part, housing assembly 52 is for resistance member 54. Housing assembly 52 completely encloses resistance member 54 and includes a proximal housing part, denoted at 110, and a distal housing part, denoted at 120. Proximal housing part 110 is carried by base 51, and distal housing part 120 is carried by handle assembly 53. Proximal and distal housing parts 110 and 120 cooperate to form housing assembly 52 and are upstanding tubular parts. As illustrated in FIGS. 1-5, 7, 11-13, 18, and 19, proximal housing part 110 has opposed extremities 111 and 112, and extends vertically upright from extremity 111 at base 51 to opposed extremity 112. Extremity 111 is the lower or inner extremity of proximal housing part 110, and extremity 112 is the upper or outer extremity of proximal housing part 110. Referencing FIGS. 3, 4A, and 4B, proximal housing part 110 completely surrounds resistance member 54 from inner end 72 of cylinder 71 to outer end 76 of operating rod 75. In this embodiment, extremity 111 is rigidly affixed to lower section 60 of base 51 around receiver 62, and proximal housing part 110 extends vertically upright from lower section 60 and footplate 61 of base 51 to extremity 112. Footplate 61 is shaped around the shape of extremity 111 of proximal housing part 110 of housing assembly 52. Proximal housing part 110 is formed by opposed halves 110A and 110B joined by welding, adhesive, or the like. Distal housing part 110 may be integrally formed, if so desired.

Distal housing part 120 of housing assembly 52 is part of, or otherwise an extension of, handle assembly 53. Distal housing part 120 has opposed extremities 121 and 122, and depends vertically downward toward extremity 112 of proximal housing part 110 of housing assembly 52 from extremity 121, rigidly affixed to hub 90, to extremity 122, illustrated in FIGS. 4A and 4B. In another aspect, distal housing part 120, in turn, extends vertically upright from extremity 122 to opposed extremity 121 at hub 90 as shown in FIGS. 4A and 4B. Extremity 121 is the upper inner extremity of distal housing part 120, and extremity 122 is the lower or outer extremity of distal housing part 120.

Distal housing part 120 is mounted extremity 122 first within proximal housing part 110 through extremity 112 of proximal housing part 110 for relative reciprocal movement therein in the direction of double arrowed line A in FIGS. 1-4B along axis X1 between the proximal, lowered, or retracted position of handle assembly 53 toward base 51, as shown in FIGS. 1, 2, and 4B, and the distal, raised, or extended position of handle assembly 53 away from base 51, as shown in FIG. 4A. The interior of proximal housing part 110 and the exterior of distal housing part 120 have complementing shapes that fit together for mutual or relative reciprocal movement. Because distal housing part 120 of housing assembly 52 is mounted for reciprocal movement to proximal housing part 1120 of housing assembly 52 in the directions of arrowed line A between the proximal, lowered, or retracted position of handle assembly 53 toward base 51 and the distal, raised, or extended position of handle assembly 53 away from base 51, proximal and distal housing parts 110 and 120 of housing assembly 52 are mutually or relatively reciprocal parts. Proximal and distal housing parts 110 and 120 are arranged about axis X1.

With continuing reference to FIGS. 3, 4A and 4B, operating rod 75 extends vertically upright from outer end 73 of cylinder 71 into distal housing part 120 of housing assembly 52 through extremity 122 of distal housing part 120 to outer end 76 of operating rod 75 located in distal housing part 120 between extremities 121 and 122. Outer end 76 of operating rod 75 is, in turn connected to distal housing part 120 of housing assembly 52, and this operatively couples/connects handle assembly 53 to resistance member 54, whereby assembly 70 provides bidirectional resistance to movement of handle assembly 53 in the direction of double arrowed line A between its proximal, lowered, or retracted position, and its distal, raised, or extended position.

Operating rod 75 is connected to housing assembly 53. To connect operating rod 75 to housing assembly 53 in a particular embodiment, a transverse intermediate wall or plate 130 is within distal housing part 120 of housing assembly between extremities 121 and 122, and is rigidly connected to the inside of distal housing part 120, such as by welding, adhesive, stays rigidly affixed to the inside of distal housing part 120, or the like. Plate 130 is located in distal housing part 120 of housing assembly 52 at an intermediate position between extremities 121 and 122. Plate 130 extends in a perpendicular or orthogonal direction relative to axis X1. Outer end 76 of operating rod 75 extends through a central opening 131 in plate 130. A collar 132 rigidly connected to operating rod 75 near outer end 76 is received against the underside of plate 130, a washer 133 applied onto outer end 76 of operating rod 75 is received against the upper side of plate 130, and a threaded fastener in the form of a threaded nut 134 is threaded onto outer end 76 of operating rod 75 and is tightened via rotation so as to clamp and secure plate 130 between collar 132 and washer 133, which distributes the load of threaded nut 134.

Proximal and distal housing parts 110 and 120 form housing assembly 52 and cooperate to completely enclose resistance member 54. The reciprocal attachment between proximal housing part 110 of housing assembly 52 and distal housing part 120 of housing assembly 53 permits handle assembly 53 to reciprocate in the directions of double arrowed line A in FIGS. 1-4B along axis X1 between a proximal, lowered, or retracted position toward base 51, as shown in FIGS. 1, 2, and 4B, and a distal, raised, or extended position away from base 51, as shown in FIG. 4A, against the resistance of resistance member 54. The coupling between operating rod 75 and handle assembly 53 causes operating rod 75 to reciprocate relative to cylinder 70 between retracted and extended positions concurrently with, and in response to, the reciprocal movement of handle assembly 53 between its proximal, lowered, or retracted position, shown in FIGS. 1, 2, and 4B, and its distal, raised, or extended position, shown in FIG. 4A, in response to the manual application of pulling and pushing forces against handle assembly 53 sufficient to overcome the resistance to reciprocal movement provided by assembly 70. Proximal and distal housing parts 110 and 120 completely enclose resistance member 54 not only in the proximal and distal positions of handle assembly 53, as shown in FIGS. 4B and 4A, respectively, but also as proximal and distal housing parts 110 and 120 mutually reciprocate at every position of handle assembly 53 between its proximal and distal positions, thereby shielding resistance member 54 from external influences and tampering. Because assembly 70 provides bidirectional resistance to reciprocal movement of operating rod 75 relative to cylinder 71, resistance member 54 resists movement of handle assembly 53 in a raising or extending direction indicated by arrowed line B in FIGS. 4A and 4B from the proximal, lowered, or retracted position of handle assembly 53 toward base 51 as shown in FIGS. 1, 2, and 4B to the distal, raised, or extended position of handle assembly 53 away from base 51 as shown in FIG. 4A, and, in turn, resists movement of handle assembly 53 in an opposite lowering or retracting direction indicated by arrowed line C in FIGS. 4A and 4B from the distal, raised, or extended position of handle assembly 53 away from base 51 as shown in FIG. 4A to the proximal, lowered, or retracted position of handle assembly 53 toward base 51 as shown in FIGS. 1, 2, and 4B. Hub 90 is received in juxtaposition directly against extremity 112 of proximal housing part 110 in the proximal, lowered, or retracted position of handle assembly 53, as is shown in FIG. 4B, and the direct contact between hub 90 and extremity 112 of proximal housing part 110 limits movement of handle assembly 53 in the lowering or retracting direction of arrowed line C past the proximal, lowered, or retracted position of handle assembly 53.

In use, resistance training apparatus 50 is set upright on the floor by setting the underside of lower section 60 of base 51 on the floor. While standing on footplate 61 on either side of extremity 111 of proximal housing part 110 of housing assembly 52 facing resistance training apparatus 50, handle assembly 53 is taken up by hand and is subjected to the manual application of forces by the user shown in FIGS. 18 and 19 pulling upwards on handle assembly 53 as in FIG. 18 so as to move handle assembly 53 in the raising or extending direction of arrowed line B from the proximal, lowered, or retracted position of handle assembly 53 toward base 51 as shown in FIG. 19 to the distal, raised, or extended position of handle assembly 53 away from base 51 as shown in FIG. 18, and pushing downwards on handle assembly 53 as in FIG. 19 so as to move handle assembly 53 in the lowering or retracting direction of arrowed line C from the distal, raised, or extended position of handle assembly 53 away from base 51 as shown in FIG. 18 to the proximal, lowered, or retracted position of handle assembly 53 toward base 51 as shown in FIG. 19. The bidirectional resistance provided by resistance member 54 provides a resistance to movement of handle assembly 53 in the raising or extending direction of arrowed line B in FIG. 18 and the lowering or retracting direction indicated by arrowed line C in FIG. 19, and this facilitates bidirectional resistance training. The bidirectional resistance allows the user to exercise for resistance training in both the raising or extending directions of handle assembly 53 and the lowering or retracting directions of handle assembly 53, changing directions at any time and as often as desired. Bidirectional resistance aids in the recruitment of reciprocal muscle groups, and reduces the risk of injury from muscle imbalance. Exercising reciprocal muscle groups also decreases localized fatigue, resulting in the ability to prolong the workout thereby achieving greater results. As explained above, the resistance to movement offered by assembly 70 can be a fixed/constant resistance, a variable resistance depending on speed of reciprocal movement (e.g., resistance increases with increased speed of reciprocal movement of handle assembly 53 and resistance decreases with decreased speed of reciprocal movement of handle assembly 53), or an adjustable resistance. In regards to adjustable resistance, resistance trailing apparatus 50 may incorporate a resistance adjustment dial 105 operatively coupled to assembly 70 to adjust, e.g. increase and decrease, the resistance to movement offered by assembly 70. Resistance adjustment dial 105 is well known in the art of bidirectional pneumatic piston-cylinder assemblies, and is operatively coupled to adjust the resistance of assembly 70 in a conventional and well-known manner. In the present embodiment with reference to FIGS. 1, 6, 8-10, dial 105 is mounted to halve 110A of proximal housing part 110 near extremity 112 of proximal housing part 110, which provides a user standing on footplate 61 to easily access dial 105 for resistance adjustment purposes during the use of resistance training apparatus 50 for resistance training purposes.

Figure 10:
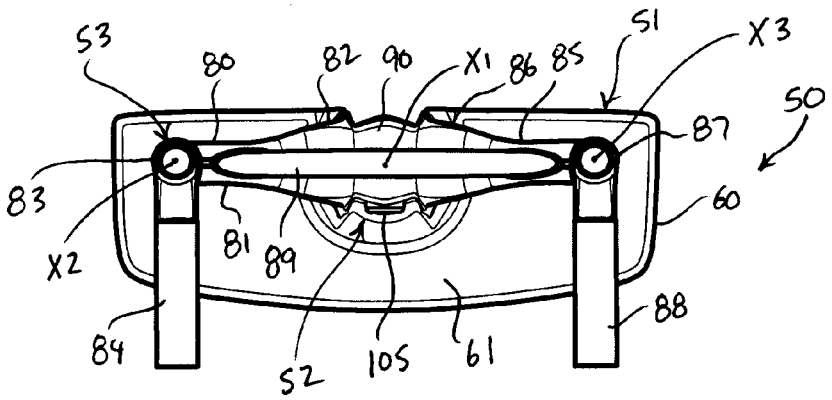
FIG. 10 is a view similar to that of FIG. 6 illustrating the handles positioned in intermediate positions between the inner positions of FIG. 6 and the outer positions of FIG. 7.
Figure 9:
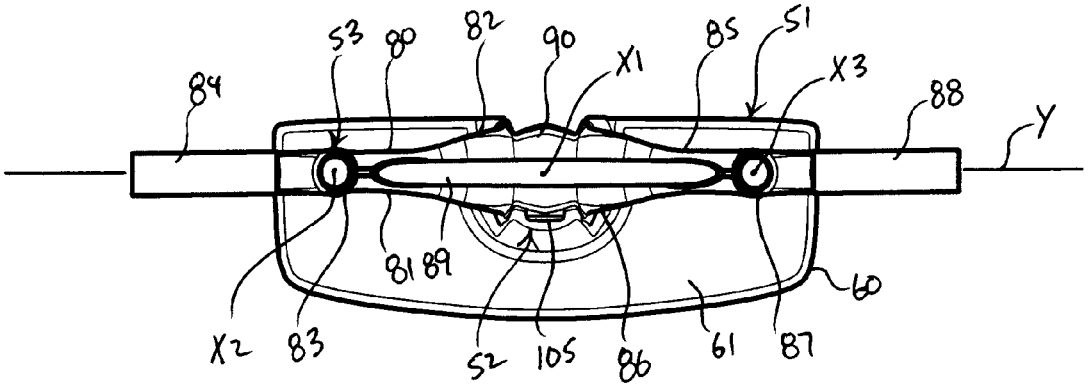
FIG. 9 is a view similar to that of FIG. 6 illustrating the handles positioned in outer positions.
Figure 11:
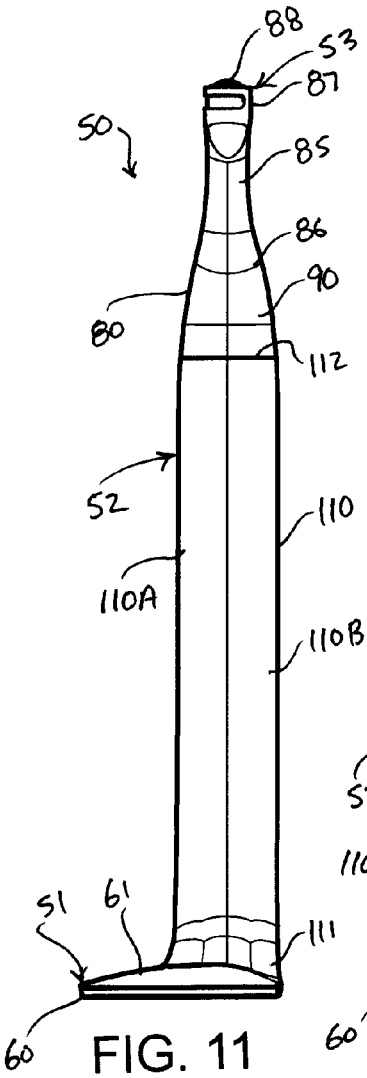
FIG. 11 is a right side elevation view of the embodiment of FIG. 1 as it would appear with the handles in the inner positions as in FIG. 8, wherein only one handle is shown concealing the opposing handle, the opposing left side elevation view being the same thereof.
Figure 12:
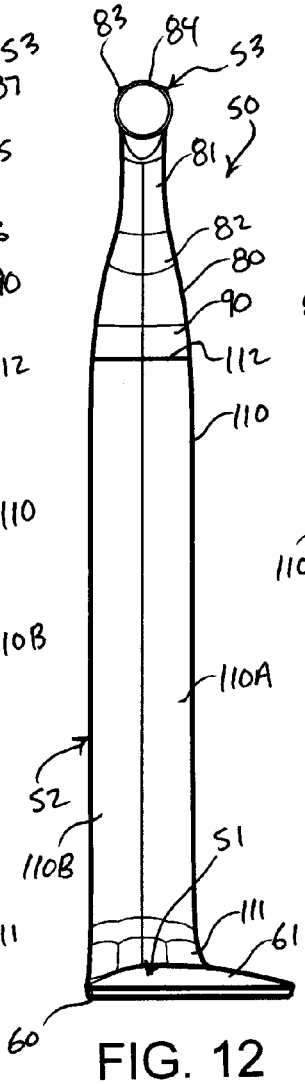
FIG. 12 is a left side elevation view of the embodiment of FIG. 1 as it would appear with the handles in the outer positions as in FIG. 9, wherein only one handle is shown concealing the opposing handle, the opposing right side elevation view being the same thereof.
Figure 13:
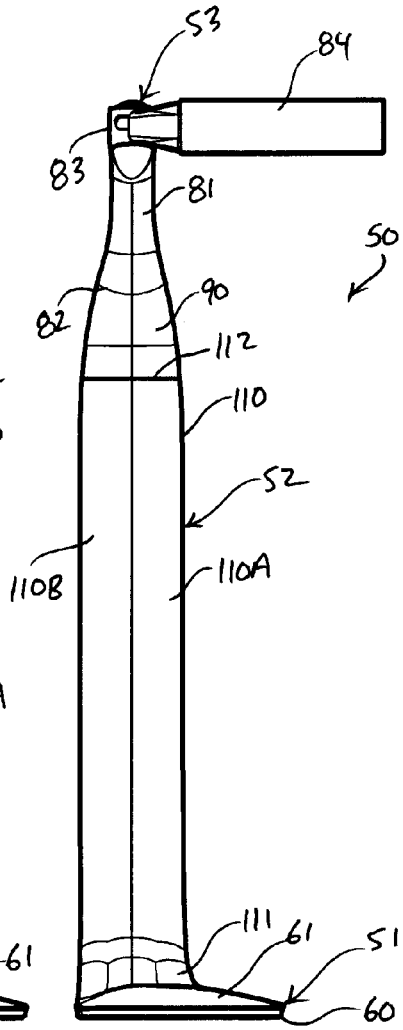
FIG. 13 is a left side elevation view of the embodiment of FIG. 1 as it would appear with the handles in the intermediate positions as in FIG. 10, wherein only one handle is shown concealing the opposing handle, the opposing right side elevation view being the same thereof.
Figure 17:
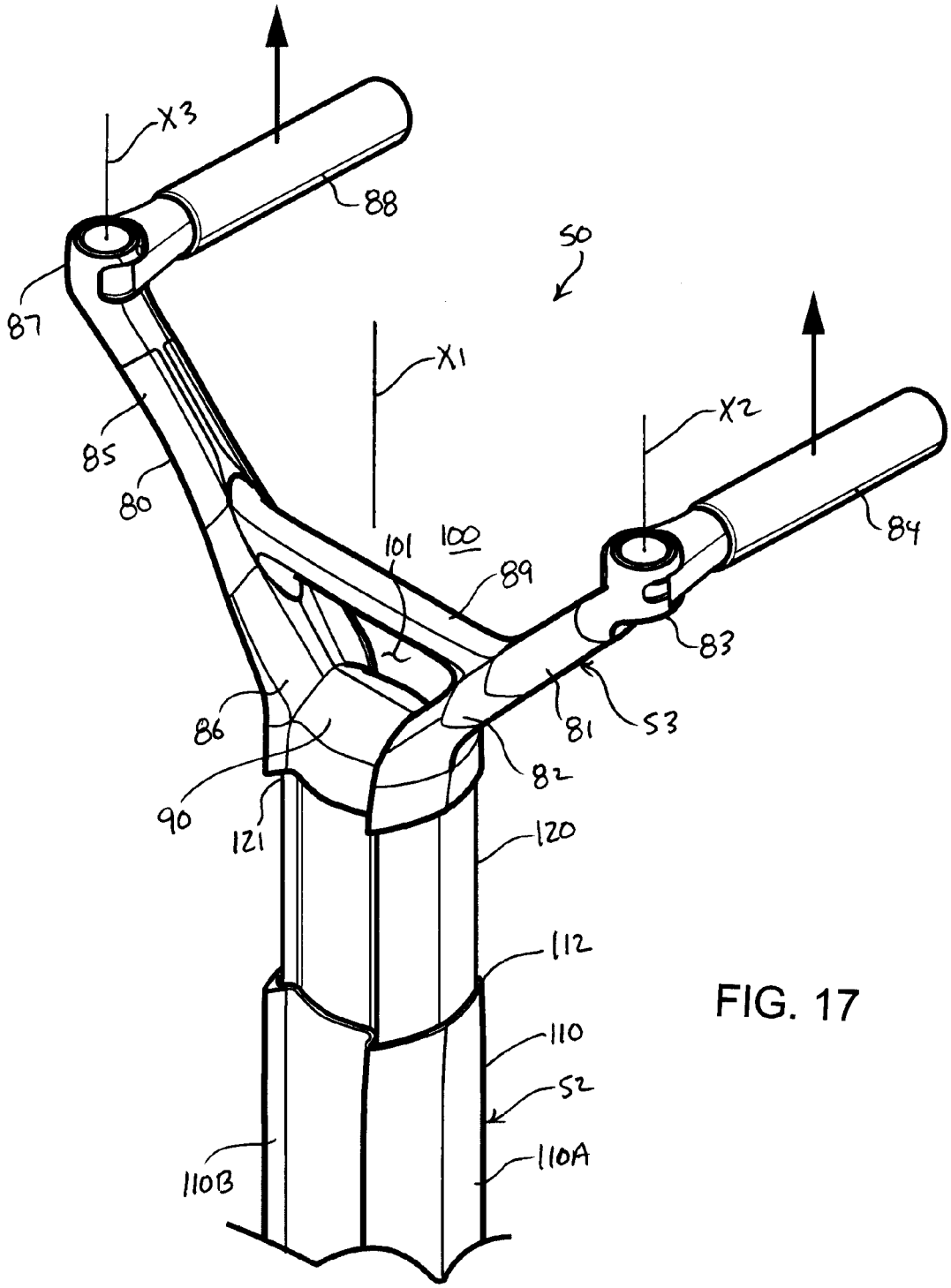
FIG. 17 is a view similar to that of FIG. 12 illustrating the handles as they would appear in the intermediate positions as in FIG. 8 and the handle assembly as it would appear in a raised position.

In use for resistance training purposes, handle assembly 53 can be taken up or otherwise gripped by hand at handles 84 and 88, and at handle 89, for the application of pulling and pushing forces against handle assembly 53. Handle 89 is a fixed handle, whereas handles 84 and 88 are mounted to outer ends 83 and 87 of arms 81 and 85 between inner positions, shown in FIGS. 1-3, 5, 7, and 8, outer positions, shown in FIGS. 9 and 19, and intermediate positions, shown in FIGS. 10 and 17, between the inner and outer positions. Handles 84 and 88 extend inwardly toward one another from outer ends 83 and 87 of arms 81 and 85 over space 100 and handle 89 in the inner positions of handles 84 and 88 shown in FIGS. 1-3, 5, 7, and 8 to provide narrow gripping for a user's hands when narrow gripping is desired for resistance training exercise. FIG. 11 is a right side elevation view of the embodiment of FIG. 1 as it would appear with handles 84 and 88 in the inner positions as in FIG. 8, wherein only one handle 88 is shown concealing the opposing handle 84, the opposing left side elevation view being the same thereof. Handles 84 and 88 extend outwardly away from one another from outer ends 83 and 87 of arms 81 and 85 in the outer positions of handles 84 and 88 as shown in FIGS. 9 and 19 to provide wide gripping for a user's hands when wide gripping is desired for resistance training exercise. Handles 84 and 88 displace 180 degrees from the inner positions to the outer positions, and displace 90 degrees from, on the one hand, each of the inner and outer positions, and, on the other hand, the intermediate positions. FIG. 12 is a left side elevation view of resistance training apparatus 50 as it would appear with handles 84 and 88 in the outer positions as in FIG. 9, wherein only one handle 84 is shown concealing the opposing handle 88, the opposing right side elevation view being the same thereof. In the inner and outer positions of handles 84 and 88, handles 84 and 88 are parallel relative handle 89, and extend along and share a common axis denoted at Y in FIGS. 1, 2, 3, 5, 7-9, and 19, which is perpendicular, e.g. orthogonal, with respect to central axis X1 of reciprocation of handle assembly 53. Handles 84 and 88 are parallel relative to each other, as seen in FIGS. 10 and 17, and extend rearwardly of halve 110A of proximal housing part 110 over footrest 61 of base 51, as seen in FIGS. 10 and 13, in the intermediate positions of handles 84 and 88 to provide parallel gripping when desired for resistance training. In the intermediate positions of handle 84, handles 84 and 88 are perpendicular, e.g. orthogonal, with respect to central axis X1 of reciprocation of handle assembly 53.

Handles 84, 88, and 89 thus provide different gripping points for applying pushing and pulling forces against handle assembly 53 for strength training exercising. Handles 84 and 88 provide for narrow gripping points in the inner positions thereof to provide narrow gripping, wide gripping points in the outer positions thereof to provide wide gripping, and parallel gripping points in the intermediate/parallel positions thereof to provide parallel gripping. Handle 89 is centered at axis X1 between outer ends 83 and 87 of arms 81 and 85, and is useful for a double-hand narrow grip, or for a single hand grip, all of for strength training exercising. Because handle 89 is centered at axis X1, in which the middle of handle 89 is arranged about axis X1, pushing and pulling forces may be applied to handle 89 at and along axis X1, which makes handle 89 useful for one-handed resistance training exercising. Depending on how handle assembly 53 is taken up, the different gripping positions provided by handles 84, 88, and 89 allows a user to use apparatus 50 for a variety of bidirectional strength training exercise for recruitment of opposed muscle groups, including, for instance, standing calf raises, standing squats, standing hamstring curls/pull downs going in the opposite direction of squats, split leg squats (one legged squats), split leg hamstring curls (one legged pull downs using hamstrings going in the opposite direction of one legged squats), deadlifts, abdominal pushdowns going in the opposite direction of deadlifts, abdominal crunches, low back hyperextensions going in the opposite direction of abdominal crunches, oblique curls, oblique low back hyperextensions going opposite direction of oblique curls, dips, close grip rows going in the opposite direction of dips, Bent over chest press, bent over back rows going in opposite direction of the bent over chest press, one armed shoulder lift gripping handle 89, one armed push down using handle 89 going in the opposite direction of the one armed lift, kneeling or seated shoulder press, kneeling or seated pull down going in the opposite direction of shoulder press, standing biceps curls, standing triceps push downs going in the opposite direction of biceps curls, trap shrugs, to name but a few.

In a preferred embodiment, handle 84 is mounted for pivotal movement with a pivotal coupling to outer end 83 of arm 81 for pivotal movement about axis X1 between its inner, outer, and intermediate positions. Handle 88 is also mounted for pivotal movement with a pivotal coupling to outer end 87 of arm 85 for pivotal movement about axis X2 between its inner, outer, and intermediate positions. Axes X1 and X2 about which handles 84 and 88 pivot, respectively, are on either side of central axis X1, all of which extend in the same, upright, vertical direction, and are parallel relative to each other. Central axis X1 is equidistant with respect to axes X2 and X3. Axes X1, X2, X3, and Y are arranged along common vertical plane in this embodiment. The pivotal coupling between handle 84 and outer end 83 of arm 81 is arranged about axis X2. The pivotal coupling between handle 88 and outer end 87 of arm 85 is, in turn, arranged about axis X3. A lock assembly is coupled between handle 84 and outer end 83 of arm 81 for selectively releasably securing handle 84 in the inner position, the outer position, and the intermediate position. Also, a lock assembly is coupled between handle 88 and outer end 87 of arm 85 for selectively releasably securing handle 88 in the inner position, the outer position, and the intermediate position. The pivotal attachment and locking assemblies between handles 84 and 88 and outer ends 83 and 87 of arms 81 and 85, respectively, are identical. As such, the details thereof will now be discussed in connection with handle 84 and outer end 83 of arm 81, with the understanding that the ensuing discussion applies equally with respect to handle 88 and outer end 87 of arm 85.

Figure 15:
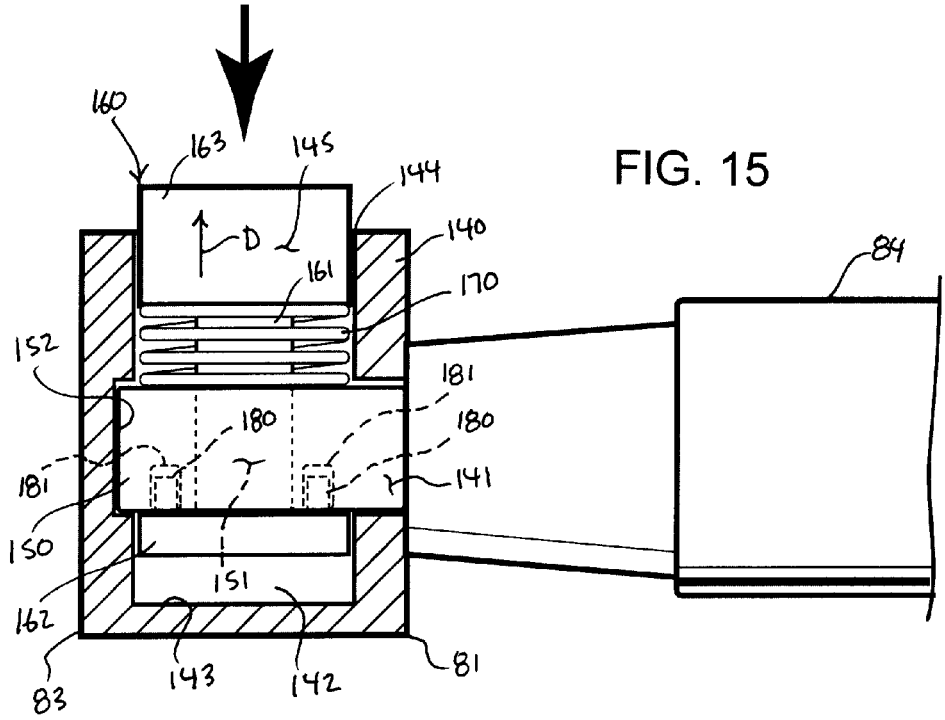
FIG. 15 is a section view of a lock assembly taken along line 15-15 of FIG. 14, the lock assembly shown in a locked position.
Figure 16:
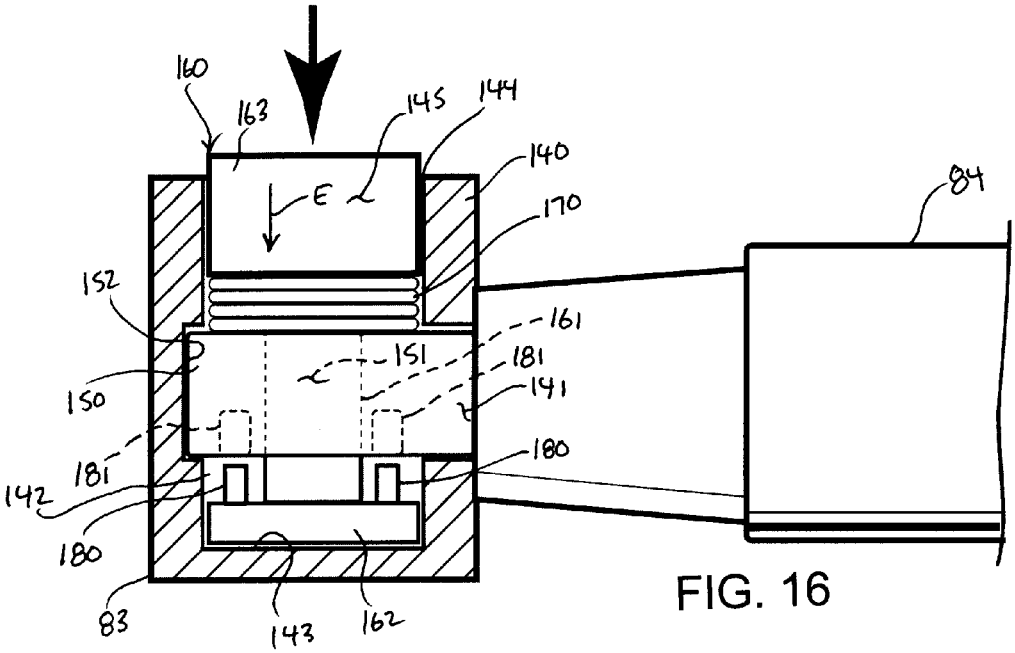
FIG. 16 is a view similar to that of FIG. 13 showing the lock assembly as it would appear in an unlocked position.

Referring to FIGS. 15 and 16, the pivotal coupling of handle 84 to outer end 83 of arm 81 includes a collar 140 formed in outer end 83. Collar 140 is arranged about axis X2 and is bifurcated. Bifurcation 141 of collar 140 leads to socket 142 formed in collar 140, which extends vertically upright from a lower end 143 to an opposite upper end 144, which bounds opening 145 into socket 142. Bifurcation 141 is between lower end 143 and upper end 144 of socket 142. The connecting end of handle 84 consists of a lug 150 having an axle opening 151. Lug 150 extends into socket 142 through bifurcation 141, and is received in an annular groove formed in socket 142 between lower end 143 and upper end 144. The pivotal coupling further includes a plunger 160 consisting of an axle or pin 161 that extends between opposed inner and outer heads 162 and 163. Plunger 160 is housed in socket 142, and is arranged about axis X2. Pin 161 extends through socket 142 between inner head 162 juxtaposed near lower end 143, and outer head 163 located at opening 145. Pin 161 extends through axle opening 151 in lug 150, which, in turn, is located between inner and outer heads 162 and 163 in socket 142. The application of pin 161 through axle opening 151 connects lug 150 to collar 140 and concurrently forms the pivotal coupling between outer end 83 of arm 81 and handle 81, in which lug 150, which is arranged about axis X2, pivots about pin 161 about axis X2 between the inner, outer, and intermediate positions of handle 84.

The locking assembly between handle 84 and outer end 83 of arm 81 used to selectively lock handle 84 in its inner position, its outer position, and its intermediate position includes a compression spring 170 in socket 142 that encircles pin 161 between outer head 163 of plunger 160 and lug 150, and an engagement assembly formed between inner head 162 and lug 150 that adjusts between an unlocked position/orientation to permit lug 150 to pivot about pin 161 between the inner, outer, and intermediate positions of handle 84, and a locked position/orientation to selectively lock lug 150 in the inner position of handle 84, the outer position of handle 84, and the intermediate position of handle 84. Spring 170 is a conventional tension spring that applies constant tension against outer head 163 and lug 150 constantly biasing/urging plunger 160 vertically upward in the direction of arrowed line D into a locked position urging inner head 162 toward lug 150 in the direction of arrowed line D and urging outer head 163 outwardly through opening 145 in the direction of arrowed line D so as to lock the locking assembly between inner head 162 and lug 150 selectively in the inner position of handle 84, the outer position of handle 84, and the intermediate position of handle 84. To unlock the locking assembly between handle 84 and outer end 83 of arm 81, outer head 163 is provided specifically as a button to be subjected to the manual application of a pressing force in the direction of arrowed line E in FIG. 16 that when sufficient to overcome the bias supplied by compression spring 170 urges plunger 160 vertically downward in the direction of arrowed line E in FIG. 16, which concurrently urges outer head 163 downwardly toward lug 150 compressing compression spring 170 therebetween, and inner head 162 downwardly toward lower end 143 of socket 142 away from lug 150 unlocking the engagement assembly between lug 150 and inner head 162 of plunger 160. When this pushing force against outer head 163 is removed, the resumption of the bias of compression spring 170 urges plunger vertically upward in the direction of arrowed line D into the locked position of FIG. 15.

Figure 14:
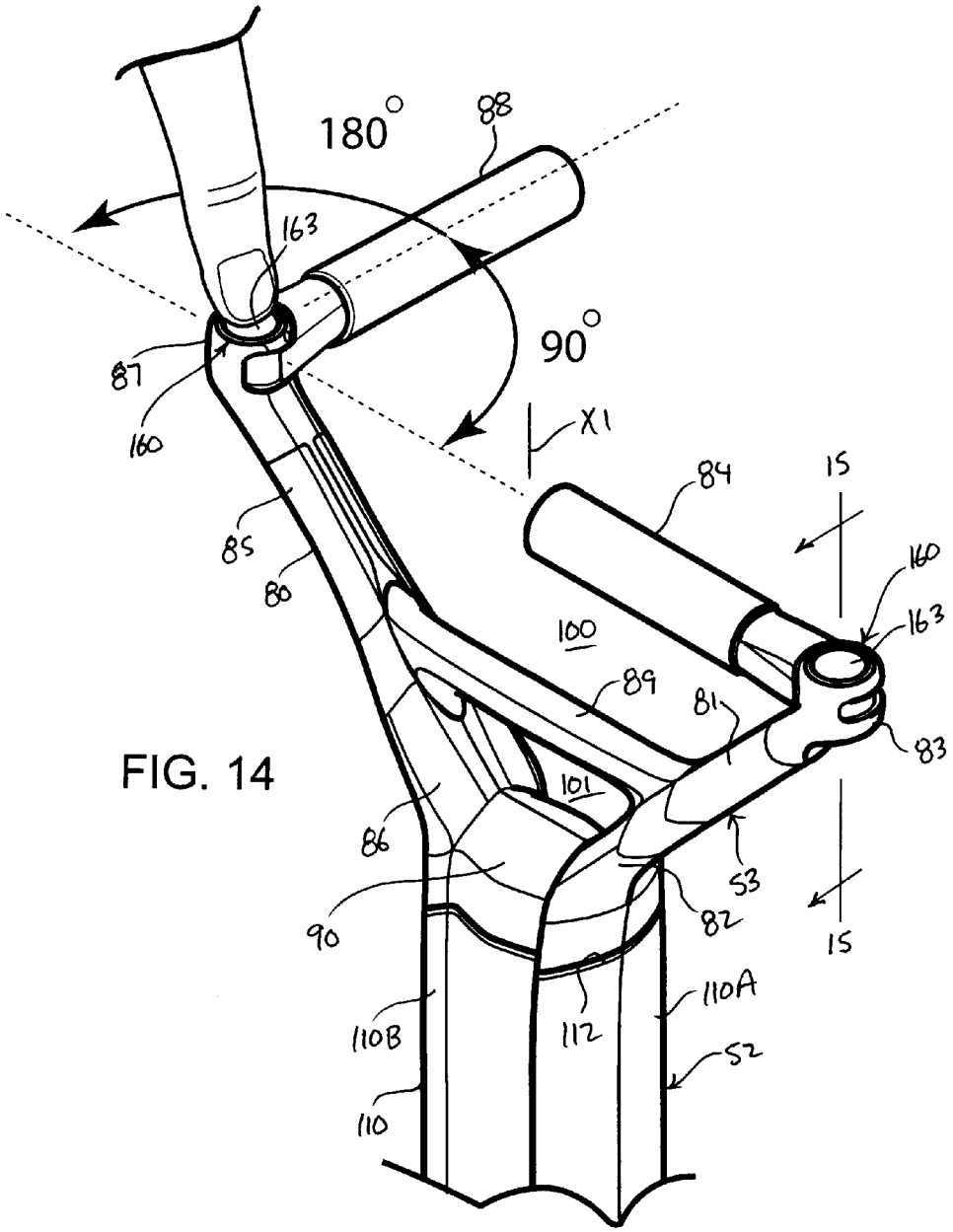
FIG. 14 is an enlarged, fragmented perspective view of the embodiment of FIG. 2 illustrating the handles of the handle assembly of the resistance training apparatus in different positions through the operation of lock assemblies.

In this example, the engagement assembly formed between inner head 162 and lug 150 includes interlocking elements that interlock/engage in the locked position of the engagement assembly so as to selectively secure handle 84 in the inner position, the outer position, and the intermediate position, and that disunite or disengage in the unlocked position of the engagement assembly to permit handle 84 to pivot without restriction between its inner, outer, and intermediate positions. In this embodiment, the interlocking elements of the engagement assembly include a series of interlocking pins 180 and corresponding sockets 181 that interlock/engage in the locked position of the engagement assembly and that disunite/disengage in the unlocked position of the engagement assembly. In this example, pins 180 are carried by inner head 162 and corresponding sockets 181 are formed in lug 150, and this arrangement can be reversed in one embodiment, and mixed-and-matched in another embodiment. Other forms of interlocking elements can be used between inner head 162 and lug 150 if so desired, including complementing sets of interlocking teeth, interlocking detents, interlocking surface texturing, or the like. As a matter of illustration and reference, FIG. 14 illustrates handle 84 as it would appear locked in its inner position, and illustrates handle 88 as it would appear locked in its intermediate position. FIG. 14 also illustrates outer head 163 of plunger 160 of the locking assembly between handle 88 and outer end 87 of arm 81 as it would appear in preparation for being depressed by finger for unlocking the locking assembly.

The invention has been described above with reference to preferred embodiments. However, those skilled in the art will recognize that changes and modifications may be made to the embodiments without departing from the nature and scope of the invention. For instance, base 51 can be provided in a variety of shapes and sizes as may be desired, such as round, oval, triangular, rectangular as in the present embodiment, square, or the like. Also, proximal housing part 110 of housing assembly 52 may be fashioned with intermediate steps on either side of housing part 110 between base 51 and extremity 112 onto which a user may step for raising his body position relative to base 51 in preparation for using apparatus 50 for resistance training exercising. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A resistance training apparatus comprising a handle assembly arranged to reciprocate along a central axis between proximal and distal positions against a source of resistance, the handle assembly includes a first arm and an opposed second arm, the first arm has a first inner end and an opposed first outer end, the second arm has a second inner end an opposed second outer end, a first handle is carried by the first outer end of the first arm, a second handle is carried by the second outer end of the second arm, the first and second handles pivot about first and second axes, respectively, on either side of the central axis, and the central, first and second axes are parallel relative to each other.

2. The resistance training apparatus according to claim 1, wherein the source of resistance provides resistance to movement of the handle assembly in a first direction from the proximal position of the handle assembly to the distal position of the handle assembly.

3. The resistance training apparatus according to claim 2, wherein the source of resistance provides resistance to movement of the handle assembly in a second direction from the distal position of the handle assembly to the proximal position of the handle assembly.

4. The resistance training apparatus according to claim 1, wherein the first and second handles pivot between inner positions, outer positions, and intermediate positions between the inner and outer positions.

5. The resistance training apparatus according to claim 4, further comprising a first lock assembly coupled between the first handle and the first outer end of the first arm for selectively releasably securing the first handle in the inner position, the outer position, and the intermediate position.

6. The resistance training apparatus according to claim 5, further comprising a second lock assembly coupled between the second handle and the second outer end of the second arm for selectively releasably securing the second handle in the inner position, the outer position, and the intermediate position.

7. The resistance training apparatus according to claim 4, wherein the first and second handles are parallel relative to each other in the intermediate positions, and share a common axis in the inner positions.

8. A resistance training apparatus, comprising:

a base;

a resistance member that provides resistance to movement, the resistance member extends from the base; and a handle assembly arranged to reciprocate along a central axis between proximal and distal positions against the resistance of the resistance member, the handle assembly includes a first arm and an opposed second arm, the first arm has a first inner end and an opposed first outer end, the second arm has a second inner end an opposed second outer end, a first handle is carried by the first outer end of the first arm, a second handle is carried by the second outer end of the second arm, the first and second handles pivot about first and second axes, respectively, on either side of the central axis, and the central, first and second axes are parallel relative to each other.

9. The resistance training apparatus according to claim 8, wherein the source of resistance provides resistance to movement of the handle assembly in a first direction from the proximal position of the handle assembly to the distal position of the handle assembly.

10. The resistance training apparatus according to claim 9, wherein the source of resistance provides resistance to movement of the handle assembly in a second direction from the distal position of the handle assembly to the proximal position of the handle assembly.

11. The resistance training apparatus according to claim 8, wherein the first and second handles pivot between inner positions, outer positions, and intermediate positions between the inner and outer positions.

12. The resistance training apparatus according to claim 11, further comprising a first lock assembly coupled between the first handle and the first outer end of the first arm for selectively releasably securing the first handle in the inner position, the outer position, and the intermediate position.

13. The resistance training apparatus according to claim 12, further comprising a second lock assembly coupled between the second handle and the second outer end of the second arm for selectively releasably securing the second handle in the inner position, the outer position, and the intermediate position.

14. The resistance training apparatus according to claim 11, wherein the first and second handles are parallel relative to each other in the intermediate positions, and share a common axis in the inner positions.

* * * * *